US006481816B1

(12) United States Patent
Oyen

(10) Patent No.: US 6,481,816 B1
(45) Date of Patent: Nov. 19, 2002

(54) METHOD OF PRINTING ON A SUBSTRATE AND A PRINTING DEVICE ADAPTED TO PERFORMING THIS METHOD

(75) Inventor: Johannes Paulus Hubertus Oyen, Roermond (NL)

(73) Assignee: Océ Technologies B.V., Venlo (NL)

( * ) Notice: Subject to any disclaimer, the term of this patent is extended or adjusted under 35 U.S.C. 154(b) by 0 days.

(21) Appl. No.: 09/596,573

(22) Filed: Jun. 16, 2000

(30) Foreign Application Priority Data

Jun. 17, 1999 (NL) ..... 1012376

(51) Int. Cl.[7] ..... B41J 29/38; B41J 29/393
(52) U.S. Cl. ..... 347/12; 347/19
(58) Field of Search ..... 347/12, 9, 43, 347/19

(56) References Cited

U.S. PATENT DOCUMENTS

| | | | | |
|---|---|---|---|---|
| 4,963,882 A | | 10/1990 | Hickman | 347/41 |
| 5,124,720 A | | 6/1992 | Schantz | 347/19 |
| 6,270,187 B1 | * | 8/2001 | Murcia et al. | 347/43 |
| 6,283,572 B1 | * | 9/2001 | Kumar et al. | 347/19 |

FOREIGN PATENT DOCUMENTS

| | | | | |
|---|---|---|---|---|
| EP | 0783973 A2 | | 7/1997 | |
| EP | 0914954 A1 | | 5/1999 | |
| JP | 6014335 A | | 6/1985 | |
| JP | 60-104335 | * | 6/1985 | 347/44 |

* cited by examiner

*Primary Examiner*—Thinh Nguyen
(74) *Attorney, Agent, or Firm*—Birch, Stewart, Kolasch & Birch, LLP

(57) ABSTRACT

A method of printing a substrate with a matrix printer provided with at least two image-forming elements, including moving the elements with respect to the substrate and activating the elements image-wise in order to provide pixels with image-forming material. In the event of breakdown of an image-forming element so that at least one pixel cannot be provided with image-forming material, the information of that pixel is transferred to an addressable position in the vicinity of the associated pixel.

10 Claims, 8 Drawing Sheets

FIG. 9

| | 1 | 2 | 3 |
|---|---|---|---|
| 1 | n - 7 | n - 3 | n + 1 |
| 2 | n – 1 | n | n - 5 |
| 3 | n + 7 | n + 2 | n - 4 |

METHOD OF PRINTING ON A SUBSTRATE AND A PRINTING DEVICE ADAPTED TO PERFORMING THIS METHOD

BACKGROUND OF THE INVENTION

1. Field of the Invention

The invention relates to a method of printing an image, built up from pixels, on a substrate, comprising moving a print head having at least two image-forming elements with respect to the substrate and activating said elements image-wise, in order to provide the pixels with image-forming material, at least one element having broken down so that at least one pixel is not provided with the image-forming material. The invention also relates to a printing device adapted to performing this method.

2. Description of the Related Art

A method of this kind is known from the Laid-Open Japanese Patent Application 60104335. In this method, use is made of an ink jet printer provided with a print head having a number of main image-forming elements, each element comprising the outflow opening of an ink duct, and reserve image-forming elements. A substrate is printed by providing pixels of a required image with ink drops generated by the main image-forming elements. If during printing an "abnormality detector" shows that there has been a breakdown of a main image-forming element, a reserve element is put into use instead of the broken-down main element in order that the associated pixels may nevertheless be provided with an ink drop. This prevents the need to interrupt the printing process in order to repair the broken-down element. A significant disadvantage of this method is that the print strategy has to be adapted in order that the associated pixels which could not be printed may nevertheless be provided with an ink drop via a reserve element, and this is at the expense of the productivity of the printing device. Another disadvantage is that the printing device must be provided with a number of reserve image-forming elements in addition to the main image-forming elements.

Another method of this kind is also known from US Pat. No. 4,963,882. This method, which makes use of an ink jet printer, proposes reducing the visible effect of the breakdown of an image-forming element. To this end, ink drops originating from different image-forming elements are printed on one pixel or one pixel row. In the former case, in which ink drops originating from different elements are printed on one pixel, a pixel is provided with two ink drops as a standard, this procedure being known as DOD "dot-on-dot" or DDA "double-dot-always". In the event of breakdown of one of the associated elements, the pixel is nevertheless always provided with one of two ink drops. In this way the visible effect of the failure of the associated image-forming element is practically nil. This method has the significant disadvantages that the productivity of the printing device is only half the maximum productivity, since each pixel must be provided with two ink drops, and also more ink is consumed per unit area of a substrate.

In the second case, in which ink drops originating from different elements are printed on one pixel row, each pixel is provided with only one ink drop, but two elements are used for each pixel row, so that different pixels in one row are provided with ink drops originating from two different elements. Frequently, each pixel row is so filled that pixels are provided one by one with ink drops originating from one or other element. In the event of failure of one of the two elements, it will be possible to provide a pixel row with the ink drops originating from the other element, so that not all the information of the pixel row needs to be lost. A significant disadvantage of this method is that on average 50% of the information in a pixel row is lost in the event of breakdown of one of the two image-forming elements. Depending on the image that should have been formed, as much as 100% of the information of the associated pixel row may be lost.

SUMMARY OF THE INVENTION

The object of the invention is to obviate these disadvantages. To this end, a method has been invented wherein by activating an element other than the said broken-down element a correction point in the vicinity of the said at least one pixel is provided with the image-forming material, the correction point not coinciding with a pixel. In other words, information which would be lost because of breakdown of an image-forming element, without the original print strategy being adapted, is transferred to a nearby addressable correction point.

This method has a number of important advantages. Firstly, the print strategy does not have to be adapted, so that using this method does not cost any productivity. In the method according to the invention, a correction point is printed in one of the original printing steps and not in an extra printing step in which extra step the associated pixel is being provided with image-forming material from another element. In addition, no reserve image-forming elements are required. Moreover, there is no need to provide each pixel with two or more drops of image-forming material so that the printing device again does not lose any productivity as a result. Finally, no information has to be lost if the method according to the invention is applied.

Although the information is printed at a location differing from an originally intended pixel, it is invisible or practically invisible to the human eye since it takes place in the vicinity of the associated pixel. The image formed on a substrate will therefore be substantially identical to the originally intended image. In a preferred embodiment, the correction point adjoins the pixel that cannot be printed by the broken-down image-forming element. This means that the correction point is selected from the group of printable locations which together surround the pixel. In this way the visible consequences of a broken-down ink duct are practically nil.

The invention also relates to a printing device adapted to performing the method according to the invention. In a preferred embodiment the printing device is an ink jet printer.

If the printing device can print a plurality of colours, for example cyan, magenta, yellow and black, in order to form a total image overall from a number of images each consisting separately of one of said colours, the method is applied for each colour image separately. In the event, for example, of breakdown of an image-forming element with which the colour cyan is printed, then for a pixel which as a result cannot be provided with a quantity of image-forming material in the colour cyan originating from the said broken-down image-forming element, a correction point will be selected which does not coincide with a cyan pixel. This correction point may well coincide with a pixel of a different colour. The choice for this is determined, among other reasons, by the distribution of the colour images over the substrate. For example, in certain cases it may be favourable to select a correction point which also does not form part of any other colour image while in other cases it may be favourable to select a correction point that in fact is a part of one of the other colour images.

No general strategy can be given for selection of a suitable correction point, i.e. a correction point such that the visible consequences of the breakdown of an image-forming element are minimal. In addition to depending on the colour composition of the required image as indicated hereinbefore, the strategy is dependent inter alia on the selected print strategy, the geometry of the print heads of the printing device, the from of image, the font size, the area coverage, the image processing method, the type of half-toning and so on. In the examples hereinafter, the invention will be explained in detail with reference to an ink jet printer adapted to application of the method according to the invention, a number of these points being discussed in greater detail.

BRIEF DESCRIPTION OF THE DRAWINGS

FIG. 4B illustrates a lack of the image, and FIG. 4C illustrates the correction image printed one pixel row lower.

FIG. 5B illustrates a lack of a portion of the image. FIGS. 5C and 5D illustrate examples of correction images.

FIG. 6B illustrates a lack of a portion of the image, and FIG. 6C illustrates the correction image.

FIG. 7B illustrates a lack of a portion of the image FIG. 8B illustrates a lack of the image, and FIG. 8C illustrates the correction image.

FIG. 9 shows that the selection of the correction points is dependent on the geometry of the print head and the associated print strategy.

DETAILED DESCRIPTION OF THE INVENTION

Figure 1:
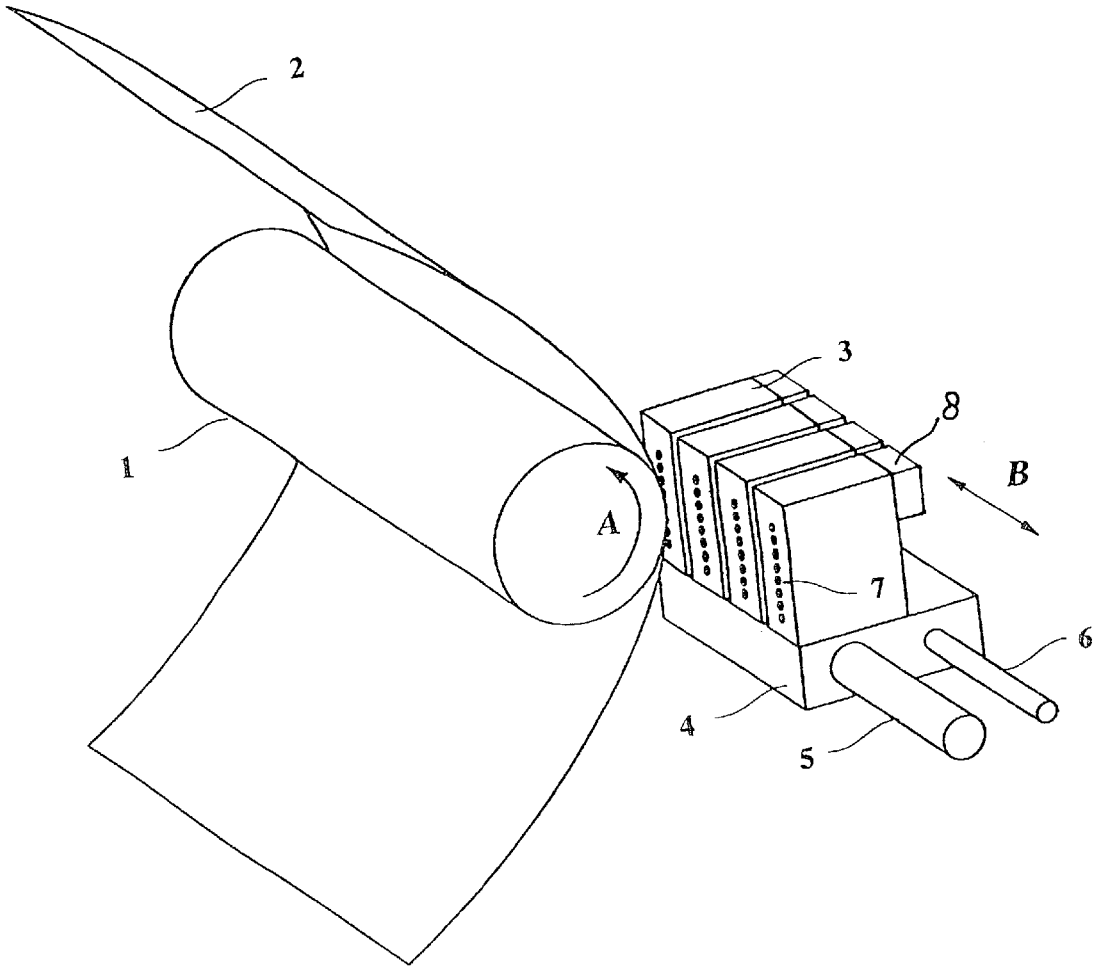
FIG. 1 is an example of a printing device provided with ink ducts.

FIG. 1 shows a matrix printing device, in this particular case an ink jet printer. In this embodiment, the printing device comprises a roller 1 for supporting a substrate 2 and moving it along four print heads 3. The roller 1 is rotatable about its axis as indicated by arrow A. A scanning carriage 4 carries the four print heads 3 and can be moved in reciprocation in the direction indicated by the double arrow B, parallel to roller 1. In this way the print head 3 can scan the receiving medium 2. The carriage 4 is guided on rods 5 and 6 and is driven by suitable means (not shown).

In the embodiment as illustrated in the drawing, each print head 3 comprises eight ink ducts, each with its own nozzle 7, which form a row perpendicular to the axis of roller 1. Each print head is provided with a nozzle failure detecting device 8, in this case comprising electrical means for determining whether or not an individual ink duct has broken down. In a practical embodiment of a printing device, the number of ink ducts per print head 3 will be many times greater. Each ink duct is provided with means for activating the ink duct (not shown) and an associated electrical drive circuit (not shown). In this way, the ink duct, the said means for actuating the ink duct, and the drive circuit form a unit which can be used for ejecting ink drops in the direction of roller 1. If the ink ducts are activated image-wise, an image forms which is built up of ink drops on the substrate 2.

When a substrate is printed with a printing device of this kind, in which ink drops are ejected from ink ducts, the substrate or part of said substrate is divided up into a number of fixed locations, which locations form a substantially regular field of pixel rows and pixel columns. Thus an imaginary field forms which is built up from separate locations each of which can be provided with one or more ink drops. In this embodiment, the pixel columns parallel to the rows of nozzles are substantially perpendicular to the pixel rows. The number of locations per unit of length in the directions parallel to the pixel rows and pixel columns is termed the resolution of the printed image, indicated, for example, as 400×600 d.p.i. ("dots per inch"). By activating the ink duct image-wise when the print heads scans the substrate, a swath of pixel rows is provided with individual ink drops. By scanning the whole substrate an image built up from individual ink drops forms on said substrate.

Figure 2:
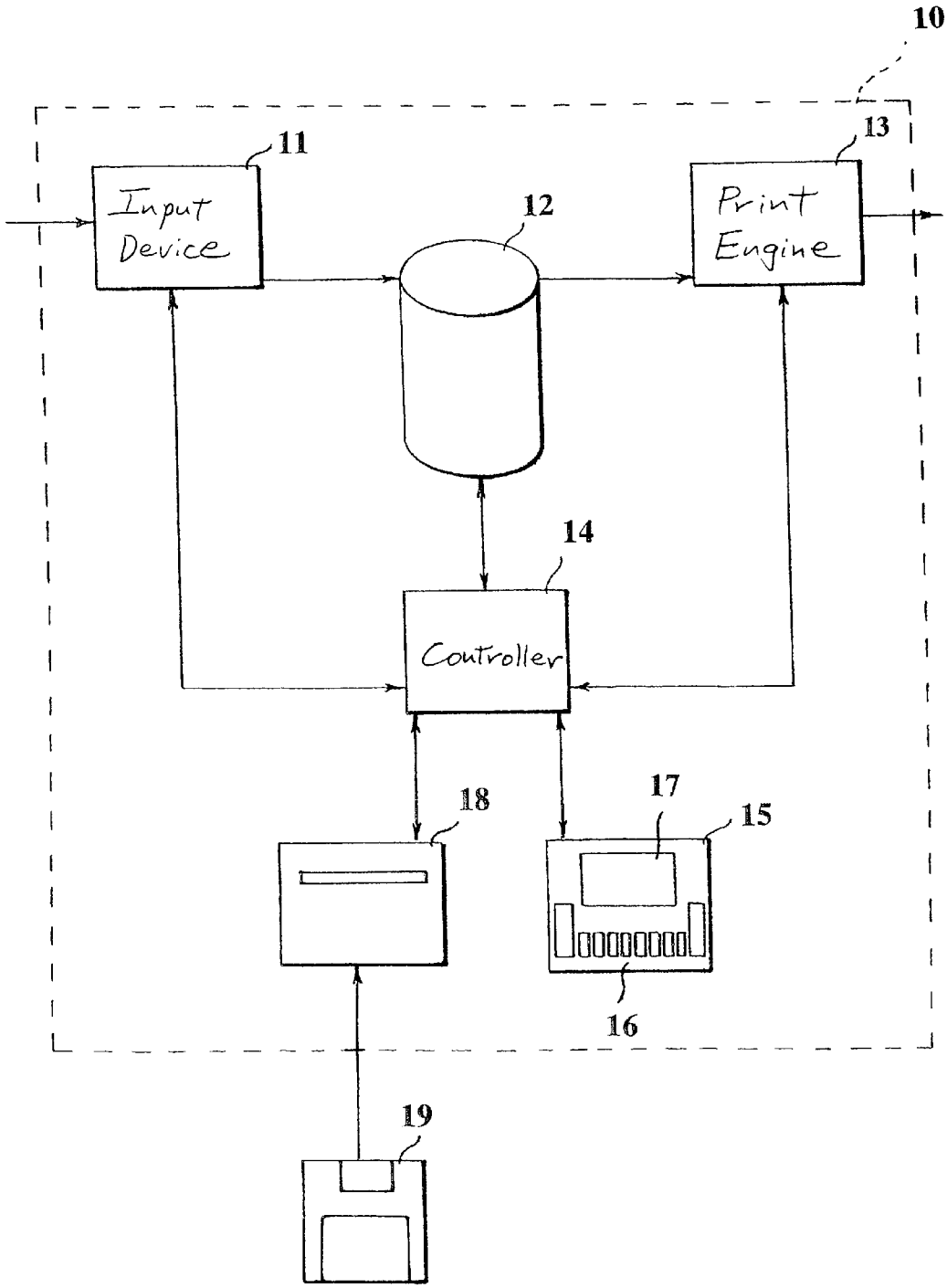
FIG. 2 diagrammatically illustrates a printing system.

FIG. 2 diagrammatically illustrates a printing system 10 according to the invention. The printing system comprises an input device 11, for example for the supply of image data, a memory 12 for storing data and a print engine 13, e.g. an ink jet print head, for printing images stored in the memory 12.

A controller 14 provides for selection of image data from the memory 12 and their supply to print engine 13, where they are printed on a receiving substrate (not shown) in accordance with the present print procedure. Operating interface 15 is connected to the controller 14 and preferably includes a number of keys 16 and a display unit 17. The controller 14 is further connected to a floppy drive 18. Image data can be input via the input device 11 or floppy drive 18. Input device 11 comprises both a scanner (not shown) for reading in paper originals and an external data interface (not shown) for receiving electronic originals. Standard printing software is written into the memory 12 after production of the printer. This software enables the printer to print image data according to the standard printing procedure. The memory 12 also comprises general correction software which enables the printer to use the method according to the invention. If the user of the printer wants to use correction software which is adapted to a specific type of images, he is able to write the corresponding specific correction software, for example present on floppy disc 19, into memory 12 via floppy drive 18. Alternatively, specific correction software is loaded from the network through said input device 11.

Figure 3:
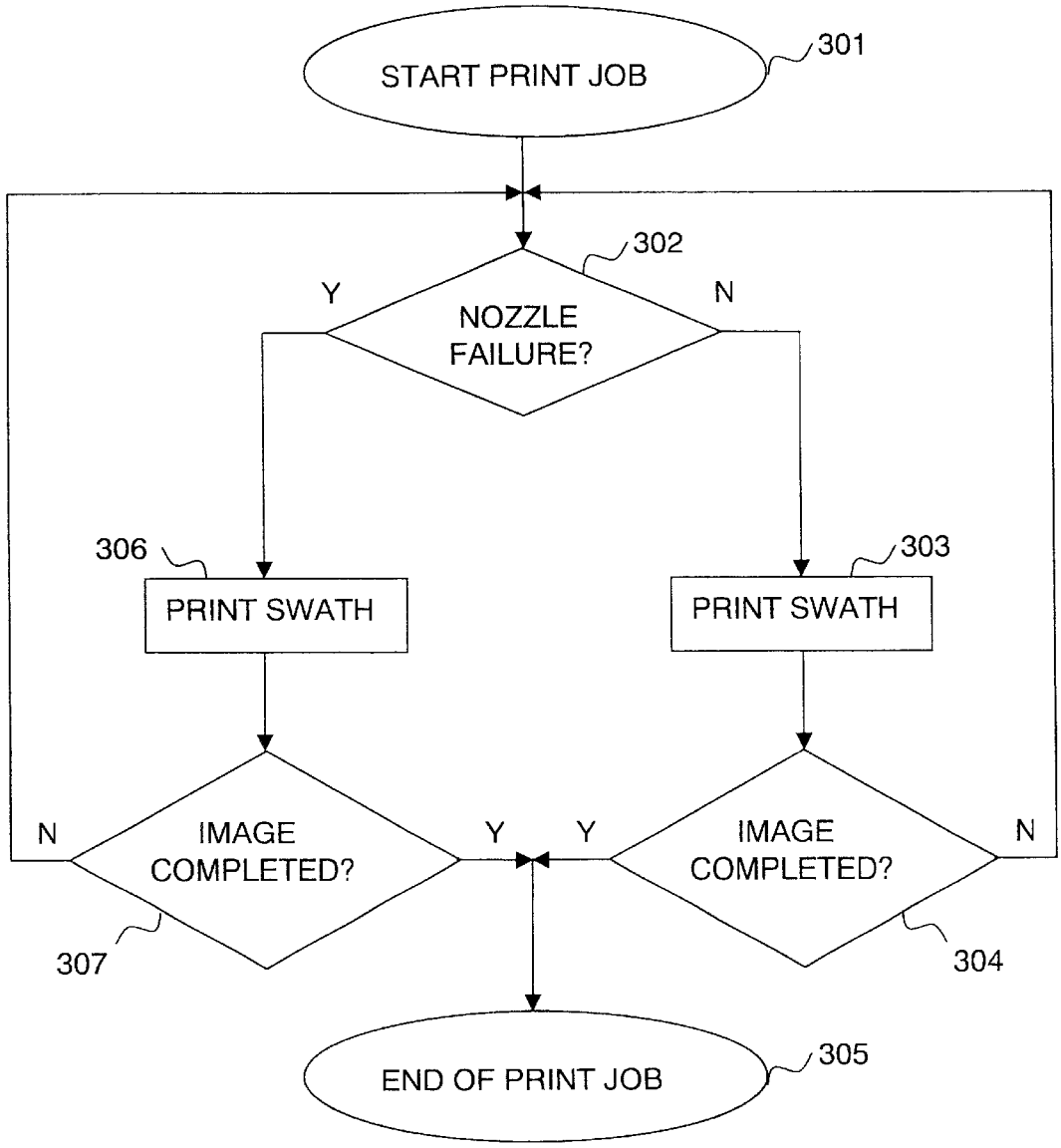
FIG. 3 shows a flow chart for a printing device suitable for using the method according to the invention.

FIG. 3 shows a flow chart for a printing device suitable for using the method according to the invention. In this particular case, the flow chart is adapted for the use with an ink jet printer comprising one print head.

The controller starts a print job in step 301. In step 302, the nozzle failure detecting device determines whether or not at least one of the ink ducts of the print head has broken down, through which the at least one corresponding nozzle fails. If not, the print head scans one swath of pixel rows of the substrate in step 303, the print head being activated image-wise during this scan, the controller using the standard printing software. After that, in step 304 it is determined by the controller whether or not the complete image has been printed during scanning of said swath. If the image is printed completely, the controller ends the print job in step 305. If the image is not completely printed yet, again step 302 is undertaken in order to determine if ink ducts have broken down. After that, the procedure is followed further in order to print the next swath of pixel rows.

If originally in step 302, the nozzle failure detecting device determines that at least one ink duct is broken down, the controller automatically switches over to correction software. Preferably, the software which is most suited for the specific type of image is automatically chosen out of the available correction software in the memory of the printer. In step 306, a swath of pixel rows is printed, the printer using the method according to the invention. After printing of said swath, it is determined in step 307 whether or not the complete image has been printed. If so, the controller ends the print job in step 305. If the image is not completely printed yet, again step 302 is undertaken in order to determine whether or not ink ducts are present which are broken down. This is necessary since other ink ducts have possibly broken down during printing of the swath and ink ducts which originally were broken down could be recovered during the print step 306. After that, the procedure is followed further in order to print the next swath of pixel rows.

Figure 4A:
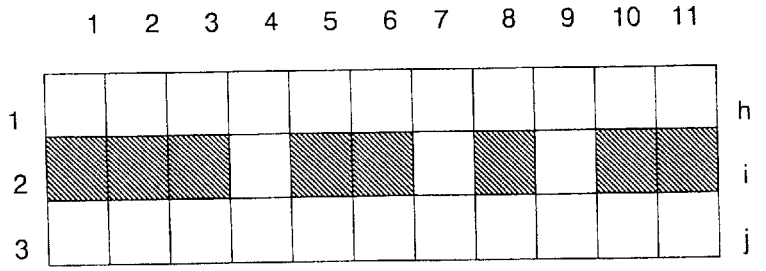
FIGS. 4A–4C illustrate an example of the application of the method to a single-pass print strategy, in which a one-dimensional image, shown in FIG. 4A, is required to be printed.

FIG. 4A shows part of a substrate divided into three pixel rows and eleven pixel columns.

If a single-pass print strategy is selected, i.e. a print strategy in which a print head is moved only once over each part of the substrate, each pixel row can only be printed by ink drops originating from one specific ink duct.

Figure 4B:
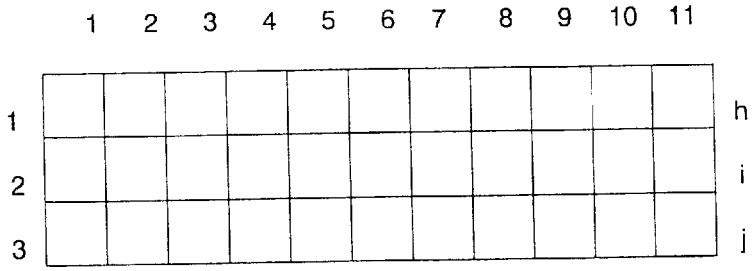
Figure 4C:
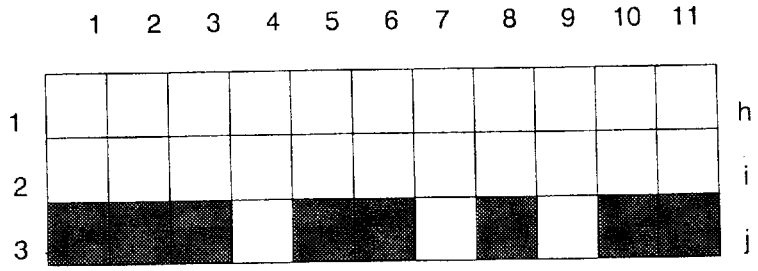

The image for printing in this example consists of the pixels indicated by shading in FIG. 4A. In this case, the image is one-dimensional and is situated in pixel row 2. In addition to the pixel rows, the drawing shows which ink ducts in the associated printing step are moved over the three pixel rows: ink duct h moves over row 1, ink duct i over row 2 and ink duct j over row 3. In the event of a breakdown of ink duct i, the pixels cannot be provided with ink drops. Unless corrective steps are taken, the image obtained is as shown in FIG. 4B: all the information has been lost. If this information were transferred to the closest addressable correction points in pixel row 3 by applying the method according to the invention, it could be printed by ink duct j in the same print step in which duct i would print the pixels in pixel row 2, so that the image shown in FIG. 4C would be obtained. Although the information is at a slightly different location, no information whatsoever has been lost, and this has been done without affecting productivity. Of course, the information could also have been transferred to pixel row 1, since the locations in that pixel row are also addressable. In addition, it is possible to transfer partly to pixel row 1 and partly to pixel row 3 the information which should have been printed in pixel row 2. The distribution of the correction points over these two pixel rows can be selected at random or alternatively in a uniform manner, for example in accordance with a specific pattern or in dependence on the image originally intended.

Figure 5A:
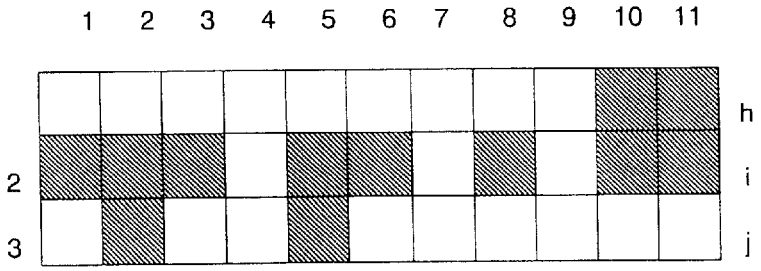
FIGS. 5A–5D illustrate an example of the application of the method to a single-pass print strategy, in which a 2-dimensional image, shown in FIG. 5A, is required to be printed.
Figure 5B:
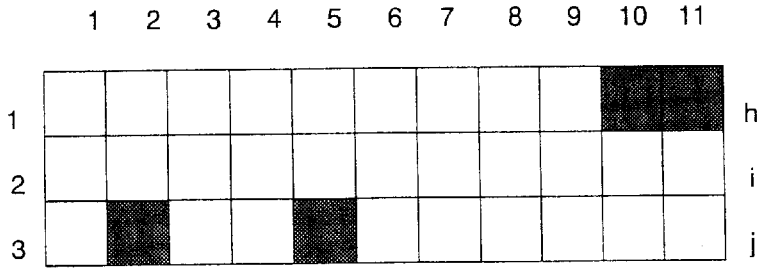
Figure 5C:
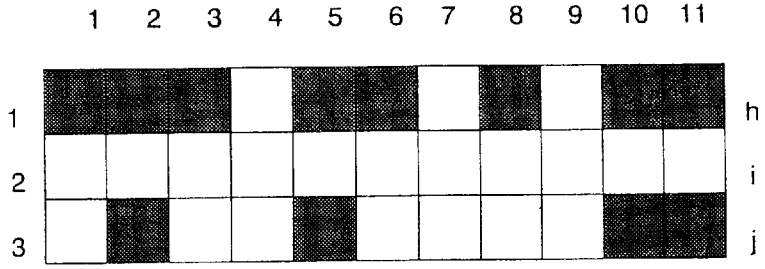
Figure 5D:
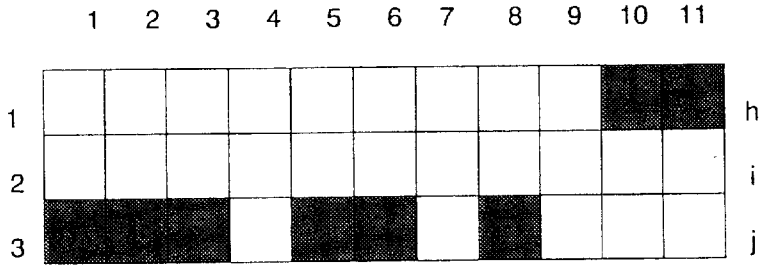

FIGS. 5A–5C give an example of the application of the method according to the invention for a 2-dimensional image. In the same way as in FIG. 4A, FIG. 5A shows the image built up from the associated pixels as it should be printed by the respective ink ducts h, i and j. FIG. 5B shows the resulting image if no corrective steps were taken in the event of breakdown of ink duct i. In a comparable manner to that indicated hereinbefore, correction points can be selected for the omitted pixels, although there are now fewer addressable pixels in the adjoining pixel rows. For example, the pixels (2, 3) (=2nd column, 3rd row), (5, 3), (10, 1) and (11, 1) are not addressable since they all belong to the image required to be formed. A choice from the other locations might, for example, lead to the selection of correction points in the pixel row opposite the associated non-addressable pixels, so that the image shown in FIG. 5C results. In this, the information of the pixels (1, 2), (2, 2), (3,2), (5,2), (6,2), (8,2), (10,2) and (11,2) has been transferred to the correction points (1,1), (2,1), (3,1), (5,1), (6,1), (8,1), (10,3) and (11,3) respectively. It is also possible to select other correction points or even not to correct all the pixels. The image shown in FIG. 5D might form in the latter manner. In this drawing we see that the pixels (2,2), (5,2), (10,2) and (11,2) are not corrected but that the printed image is similar to the intended image as shown in FIG. 5A.

Figure 6A:
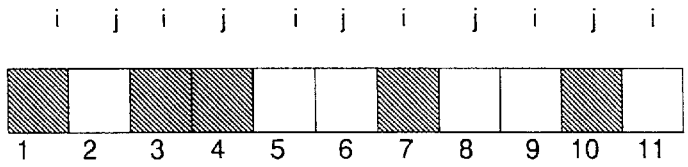
FIGS. 6A–6C illustrate an example of the application of the method to a multi-pass print strategy for a one-dimensional image, shown in FIG. 6A, in which correction points are selected within the same dimension.

FIG. 6A shows one pixel row with an image for printing built up from five pixels, in which a two-step print strategy is applied and the substrate is printed in accordance with a "chessboard" pattern. In this strategy, ink duct i is first moved over the associated pixel row, and in this case ink drops can be printed on the odd locations in the pixel row. In this print step, ink duct j moves over a pixel row (not shown) parallel to the pixel row shown in FIG. 6A. After the (illustrated) pixel row has been printed, the print head of the printer is so displaced with respect to the substrate that ink duct j is situated above this pixel row. The print head is then moved over the pixel row in the opposite direction, and ink drops originating from duct j can be printed on the intermediate even locations. In this way, the image as shown in FIG. 6A can be built up in two separate printing steps.

Figure 6B:
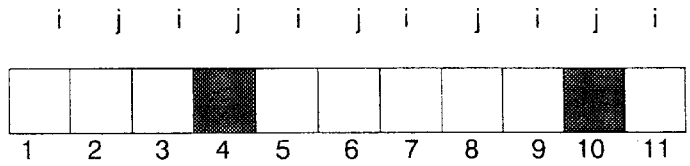
Figure 6C:
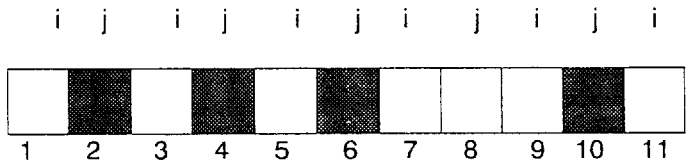

FIG. 6B shows the image forming in the event of breakdown of ink duct i. It will be seen that despite the use of a multi-step printing strategy there is a loss of 60% of the information. If this information were transferred to correction points selected from addressable pixels in the same pixel row, in this case the even locations 2, 6 and 8 (of course locations 4 and 10 already belong to the image requiring to be formed), this, for example, gives the image shown in FIG. 6C.

In this, the information of the pixels situated at the locations 1 and 7 is transferred to the addressable locations 2 and 6. Because pixel 3 has not been corrected, there is of course a loss of 20% of the information, but that is much less than the 60% resulting from the use of a two-step print strategy. If, in addition, it were possible to select correction points in adjoining pixel rows, which for the sake of simplicity have not been shown in the drawing, there would of course be no need for any loss of information whatever.

Figure 7A:
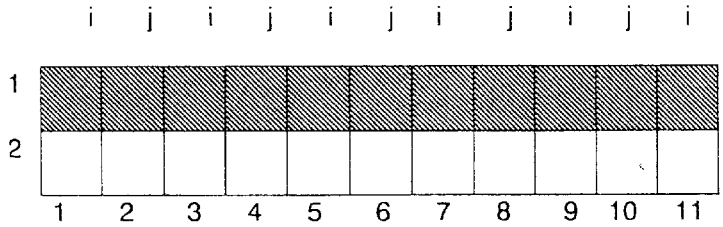
FIGS. 7A–7C illustrate an example of the application of the method to a multi-pass print strategy for a one-dimensional image, shown in FIG. 7A, in which correction points are selected outside this dimension, as shown in FIG. 7C.
Figure 7B:
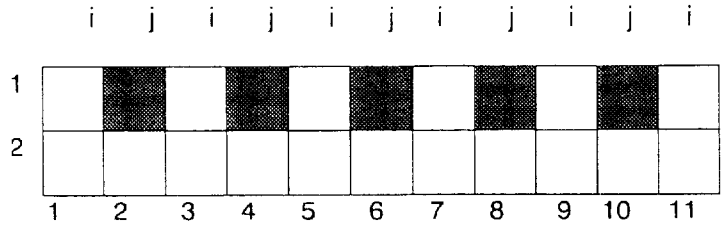
Figure 7C:
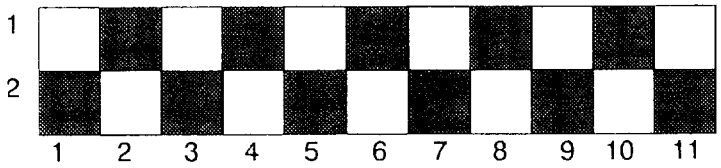

In comparable manner to FIGS. 6A and 6B, FIGS. 7A and 7B show the result of breakdown of one of two ink ducts using a two-step printing strategy. In this example, the image for printing consists of a single pixel line which is to be imaged on pixel row 1. In the event of breakdown of ink duct i, this results in a loss of 50% of the information. FIG. 7C shows one of the possibilities whereby the image could be corrected by the application of the method according to the invention: the information which should have been printed on the odd locations in pixel row 1 is transferred to the odd pixel locations in pixel row 2. These locations can be printed if another working ink duct that prints to said odd pixels moves over the associated pixel row 2. In this way no information is lost.

Figure 8A:
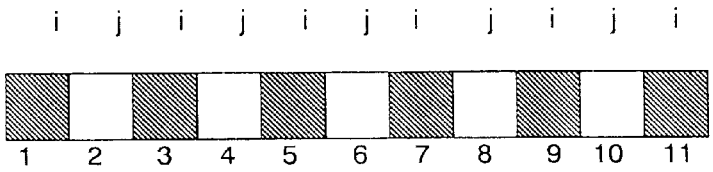
FIGS. 8A–8C illustrate a third example of application of the method to a multi-pass print strategy for a one-dimensional image, shown in FIG. 8A.
Figure 8B:
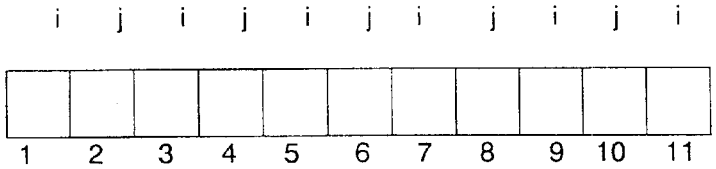
Figure 8C:
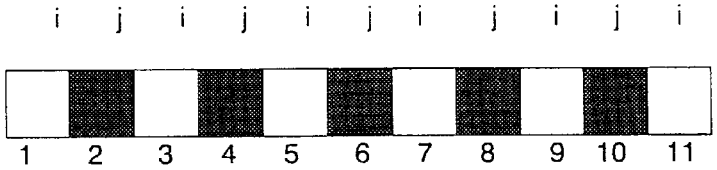

FIGS. 8A–8C show that even a loss of 100% of the information can occur using the known multi-step print strategy. FIG. 8A shows a thinned-out single pixel line of the kind that regularly occurs in CAD/CAM drawings. In the event of breakdown of ink duct i using a two-step print strategy, all the information is lost as will be apparent from FIG. 8B. Using the method according to the invention, in which the information of the uneven locations is transferred, for example, to the even locations in the same pixel row, no information whatever is lost and it is even impossible for the human eye to distinguish between the intended image as shown in FIG. 8A and the printed image by using the method according to the invention, as shown in FIG. 8C.

FIG. 9 shows that selection of a correction point does not depend solely on the number of available addressable correction points in the vicinity of the pixel which cannot be provided with image-forming material, but also on the geometry of the print head and the print strategy selected therewith. For example, the printing columns of printers which use "piezo technology" frequently have a resolution which is much lower than the required print resolution, e.g. a resolution of 75 n.p.i. (nozzles per inch) compared with a resolution of 600 d.p.i. (dots per inch) for the image for printing. To solve this problem, one of the options is to print a strip of the substrate in eight steps, in which the printing column is always shifted 1/600 th of an inch with respect to the substrate. There are thus a number of options resulting in space-time relationships of varying complexity between the locations for printing and the available image-forming elements. This in turn affects the selection of correction points from the available addressable locations. In FIG. 9, part of the substrate for printing is subdivided into three pixel columns and three pixel rows. The space-time relationship of the print strategy is indicated at the associated points: the drawing shows for each location the print step in which the locations can be printed: location (1,1) (=1st column, 1st row) can be printed in print step (n−7), location (2,1) can be printed in step (n−3) etc. Let us assume that location (2,2) is a pixel and that the other locations do not form part of the image for printing. This means that location (2,2) should be provided with an ink drop in step n of the printing process. In the event of breakdown of the associated ink duct, then the other locations in principle form a set of addressable points from which a correction point can be selected. In the event of breakdown of the associated ink duct in step n−2, the result of this is that the locations (1,1), (2,1), (3,2) and (3,3) cannot serve as correction points because they could have been printed respectively in the (n−7)th, (n−3)th, (n−5)th and (n−4)th step. When these print steps were performed, of course, it was not then known that ink duct i would fail in step n−2. This means that using this print strategy only the correction points (3,1), (1,2), (1,3) and (2,3) are available for taking over the information of pixel (2,2).

The method according to the invention can be used not only to form images on 2-dimensional support materials, but also in the formation of 3-dimensional objects using object-forming means which build up an object dot-wise, as is the case, for example, in the fabrication of models using ink jet printers.

A condition for the successes application of the method according to the invention is that it should be possible to determine which ink ducts have broken down in a printer. Various options are known for this purpose. For example, a test print can be made in which each ink duct is required to print a specific line on a substrate: the broken-down ink ducts can then be recognised by simple visual inspection of the associated test print. The ink ducts can also be checked as to their operation even during printing, optically, electronically, or in some other manner. The choice of one of these options does not affect this invention.

What is claimed is:

1. A method of printing an image, built up from pixels, on a substrate, comprising:

moving a print head having at least two image-forming elements with respect to the substrate;

activating said elements to provide the pixels with image-forming material, at least one element having broken down so that at least one pixel is not provided with the image-forming material;

establishing whether there is at least one addressable correction point in the vicinity of said at least one pixel; and if so;

transferring the information corresponding with said at least one pixel to said addressable correction point; and activating an image-forming element other than said broken-down element in order to provide said correction point with the image-forming material, the correction point not coinciding with one of said pixels, wherein the image forming element, other than said broken-down element, is available to provide pixels with image forming material before the at least one element has broken-down.

2. A method according to claim 1, wherein the correction point adjoins said at least one pixel.

3. The method according to claim 1, wherein if it is established that there are several addressable correction points, at least one of those points is selected, and the information is transferred to said selected correction point.

4. The method according to claim 1, wherein the printing is performed with a printer having the ability to print a plurality of colors, and wherein said method is performed for each color, separately.

5. A printing device for printing an image, built up from pixels, on a substrate, comprising:

a print head provided with at least two image-forming elements to move with respect to the substrate and the elements being activated to provide the pixels with image-forming material, at least one element having broken down so that at least one pixel is not provided with the image-forming material; and a controller to activate an image-forming element other than said broken-down element so that a correction point in a vicinity of said at least one pixel is provided with the image-forming material, the correction point not coinciding with one of said pixels, wherein the image forming element is available to provide pixels with image forming material before the at least one element has broken-down.

6. A printing device according to claim 5, wherein the correction point adjoins the said at least one pixel.

7. A printing device according to claim 5, wherein the printing device is an ink jet printer.

8. A printing device according to claim 6, wherein the printing device is an ink jet printer.

9. A computer-readable medium containing a program or script for controlling the printing of an image, built up from pixels, on a substrate using a print head having at least two image-forming elements, the program or script comprising:

a first program portion to detect whether an image forming element in the print head has broken down;

a second program portion to activate said elements to provide the pixels with image-forming material, if no image forming element in the print head has broken down; and a third program portion to activate an image-forming element other than said broken-down element, if the image forming element in the print head has broken down, so that a correction point in a vicinity of pixels corresponding to the broken down element is provided with the image-forming material, the correction point not coinciding with one of said pixels corresponding to the broken down element, said image forming element being available for printing before the at least one element has broken-down.

10. A computer-readable medium according to claim 9, wherein the correction point adjoins said pixels corresponding to the broken down element.

* * * * *